US006689032B2

(12) United States Patent
Möbius et al.

(10) Patent No.: US 6,689,032 B2
(45) Date of Patent: Feb. 10, 2004

(54) PROCESS FOR PRODUCING FOLDED PRODUCTS, AND FOLDER FOR THIS PURPOSE

(75) Inventors: Marc Möbius, Weimar (DE); Theo Keilhau, Neusäss (DE)

(73) Assignee: MAN Roland Druckmaschinen AG, Offenbach am Main (DE)

( * ) Notice: Subject to any disclaimer, the term of this patent is extended or adjusted under 35 U.S.C. 154(b) by 0 days.

(21) Appl. No.: 09/793,197

(22) Filed: Feb. 26, 2001

(65) Prior Publication Data

US 2002/0019302 A1 Feb. 14, 2002

(30) Foreign Application Priority Data

Feb. 26, 2000 (DE) ..... 100 09 263

(51) Int. Cl.[7] ..... B31B 1/26
(52) U.S. Cl. ..... 493/23; 493/397; 493/405
(58) Field of Search ..... 493/11, 23, 397, 493/405, 187, 374, 12, 16; 270/32, 45, 51

(56) References Cited

U.S. PATENT DOCUMENTS

| | | | | | |
|---|---|---|---|---|---|
| 3,289,835 | A | * | 12/1966 | Dalin | 209/3.3 |
| 3,433,135 | A | * | 3/1969 | Loky et al. | 493/12 |
| 4,135,708 | A | * | 1/1979 | Faltin | 270/52.24 |
| 4,696,464 | A | * | 9/1987 | Gammerler | 198/418.1 |
| 4,988,330 | A | * | 1/1991 | Bensberg | 493/11 |
| 5,119,725 | A | | 6/1992 | Okamura | |
| 5,435,534 | A | * | 7/1995 | Linkowski et al. | 270/51 |
| 5,458,062 | A | | 10/1995 | Goldberg et al. | |
| 5,520,378 | A | * | 5/1996 | Kepert et al. | 270/45 |
| 6,019,714 | A | * | 2/2000 | Stab | 493/23 |
| 6,102,536 | A | * | 8/2000 | Jennel | 347/100 |
| 6,176,485 | B1 | * | 1/2001 | Wingate | 271/303 |
| 6,244,593 | B1 | * | 6/2001 | Schaefer et al. | 271/270 |
| 6,440,049 | B1 | | 8/2002 | Belanger et al. | |

FOREIGN PATENT DOCUMENTS

| | | |
|---|---|---|
| DE | 40 09 415 A1 | 11/1990 |
| DE | 40 09 415 | 11/1990 |
| DE | 195 06 774 A1 | 8/1995 |
| DE | 198 56 373 A1 | 8/1999 |

* cited by examiner

*Primary Examiner*—Rinaldi I. Rada
*Assistant Examiner*—Paul R Durand
(74) *Attorney, Agent, or Firm*—Cohen, Pontani, Lieberman & Pavane

(57) ABSTRACT

In folded-product production in which a product stream is split up into at least two sub-streams which each run through an associated folding arrangement and are then reunited, it is possible to achieve a high level of user-friendliness and good cost-effectiveness in that at least one sub-stream is assigned a marking arrangement for marking the products passing it, with the result that, upon detection of inaccuracies stemming from the folding operation carried out following the splitting-up action, said products can immediately be assigned to the associated sub-stream, and thus to the folding arrangement belonging to said sub-stream.

12 Claims, 1 Drawing Sheet

PROCESS FOR PRODUCING FOLDED PRODUCTS, AND FOLDER FOR THIS PURPOSE

BACKGROUND OF THE INVENTION

1. Field of the Invention

The invention relates, to a process for producing folded products, a product stream being split up into at least two sub-streams which, once the products have undergone a final folding operation, are reunited, and the reunited product stream being observed and, following the detection of products with inaccuracies stemming from the folding operation carried out following the splitting-up action, adjustment of the relevant folding arrangement taking place. The invention relates further to a folder which has a diverter for splitting up a product stream into a plurality of sub-streams which each contain at least one adjustable folding arrangement, preferably designed as a longitudinal-folding arrangement, and which can be fed to a common delivery arrangement.

2. Description of the Related Art

The splitting up of the product stream in the folder usually takes place before the so-called quarter fold is produced. The reason for this is that a folding arrangement for achieving a quarter fold usually allows a considerably smaller throughput than the printing machine provided upstream of the folder, with the result that, if use is made of just one folding arrangement for producing the said fold, it would not be possible for the capacity of the printing machine to be fully utilized. Up until now, however, it has no longer been possible, once the sub-streams have been reunited, to assign the individual products to the different sub-streams. If, during observation of the reunited product stream, products with inaccuracies in the quarter fold are detected, it has not been possible, up until now, to carry out a quick, specific adjustment of the relevant folding arrangement. Rather, up until now, tests have had to be conducted to find out which folding arrangement is involved. It is only when the relevant folding arrangement has been established that adjustment is possible. According to experience, this results in a high number of inaccurately folded and thus low-quality or completely unusable products being produced.

SUMMARY OF THE INVENTION

The object of the present invention is to improve a process and a folder of the type mentioned above using straightforward and cost-effective means, such that, upon detection of products with inaccuracies stemming from the folding operation carried out following the splitting-up action, specific correction is permitted and the number of rejects produced is thus kept as small as possible.

This object is achieved according to the invention in that, taking the process of the generic type as the departure point, at least in the case of detection of products with inaccuracies stemming from the folding operation carried out following the splitting-up action, the products of at least one sub-stream are marked at least for a short time before the sub-streams are reunited. For this purpose, in a folder of the type mentioned above at least one sub-stream is assigned a marking arrangement for marking the products passing in it.

The process of the invention involves splitting a feeding stream of products into at least two product sub-streams. Each sub-stream is then passed through an associated final folding unit with the final folded sub-streams being united into a common products stream at a delivery station downstream of the folding units. The products of the common stream are monitored to detect any final folding inaccuracies therein. On detection of a product folding inaccuracy, products of at least one of the sub-streams are marked following final folding but before reuniting the sub-streams. This enables the sub-stream containing the marked products to be identified in the common stream from the products of the other sub-stream. Adjustment of the folding unit associated with the identified sub-stream then can be made to eliminate the inaccuracy causing condition.

These measures completely eliminate the disadvantages outlined in the introduction. The marking of the products advantageously makes it possible for said products to be assigned to the individual sub-streams. On account of the products being assigned reliably to the individual sub-streams, the corrections which are necessary in the case of folding inaccuracies can be carried out in a specific manner with a 100% success rate. This means that the period of time required for eliminating defects is shortened to a not inconsiderable extent in comparison with the prior art, as a result of which the number of rejects produced in this time is reduced considerably in comparison with the prior art. The measures according to the invention thus give a high level of user-friendliness and result overall in excellent cost-effectiveness.

The invention also provides a folder for producing folded products which includes a diverter for splitting a stream of feeding products into at least two sub-streams. Separate adjustable folding units associated with each of the sub-streams longitudinally fold the products in the respective sub-streams. The sub-streams thereafter pass downstream to a common delivery station. A marking unit is disposed proximal a travel course of at least one of the sub-streams for marking products in that sub-stream.

By a monitoring at the common delivery station, this marking is employed to identify the sub-stream from whence come any inaccurately folded products and, accordingly, adjusting the folding unit associated with the sub-stream to eliminate the cause of inaccuracies is effected.

It is expediently possible for the marking to be provided only on a product region or part of a product which can be removed during subsequent processing of the product. This means that the products remain saleable as long as the folding defect does not render the products market unacceptable.

A further advantageous measure may consist in that, in order to mark the products, a marking means which is visible or can be made visible is applied to said products. Such a means may advantageously be sprayed on or jetted on, which allows a contact-free application which does not have any adverse effects. In particular in the case of a jetting-type application, a high level of target accuracy is also advantageously ensured.

A particularly expedient development of the generic folder may consist in that a switching arrangement for actuating the marking arrangement is arranged in the region of the common delivery arrangement. This ensures that, upon detection of folding inaccuracies, a printer who is observing the product stream on the common delivery arrangement can actuate the marking arrangement according to the invention manually for a short time. Even after just a short period of time, the marked products appear on the common delivery arrangement, as a result of which it is possible to assign the products to the individual sub-streams, and thus also to assign the defective products to the relevant folding arrangements.

The marking arrangement may advantageously be arranged in the region between the folding arrangement of the associated sub-stream and the common delivery arrangement. This ensures that the products running past the marking arrangement are marked on their outside, with the result that the marking can also easily be seen in the region of the common delivery arrangement.

For the customary action of splitting up into two sub-streams, it is sufficient if the products of only one sub-stream are marked. This makes it possible to keep the necessary outlay within limits and to achieve good distinguishability.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

DETAILED DESCRIPTION OF THE PRESENTLY PREFERRED EMBODIMENTS

Figure 1:
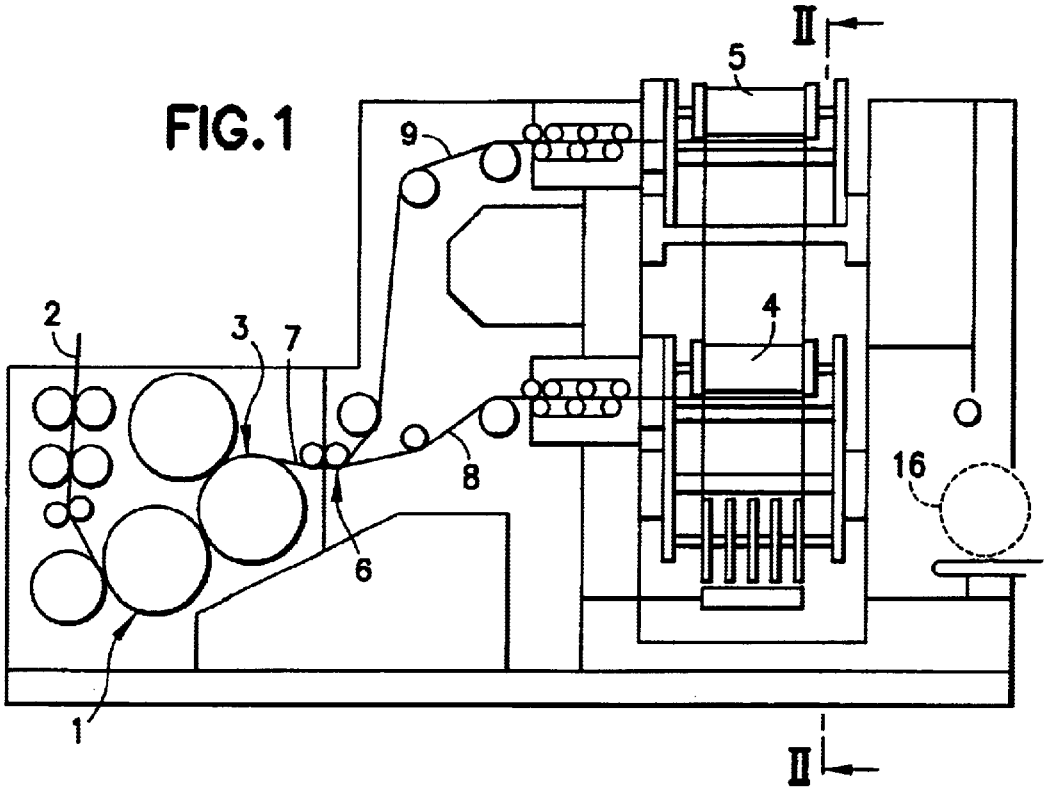
FIG. 1 is a side view of a folder with two longitudinal-folding arrangements which are arranged one above the other and used for making a so-called quarter fold.

The folder as can best be seen from FIG. 1, includes a cross-cutting arrangement 1 which is intended for subdividing a fed continuous web 2, which usually already has a first longitudinal fold, into successive products, a crossfolding arrangement 3, which is provided downstream of the cross-cutting arrangement 1 and is intended for producing a cross fold and two longitudinal-folding arrangements or units 4, 5, which are provided downstream of the cross-folding arrangement 3, are arranged one above the other, are designed in this case as knife folders and are intended for producing a so-called quarter fold. Located downstream of the cross-folding arrangement 3 is a diverter 6 by means of which the product stream 7 leaving the cross-folding arrangement 3 is split up into two sub-streams 8, 9 which are arranged one above the other and are assigned to the longitudinal-folding arrangements 4, 5, which are arranged on above the other.

Figure 2:
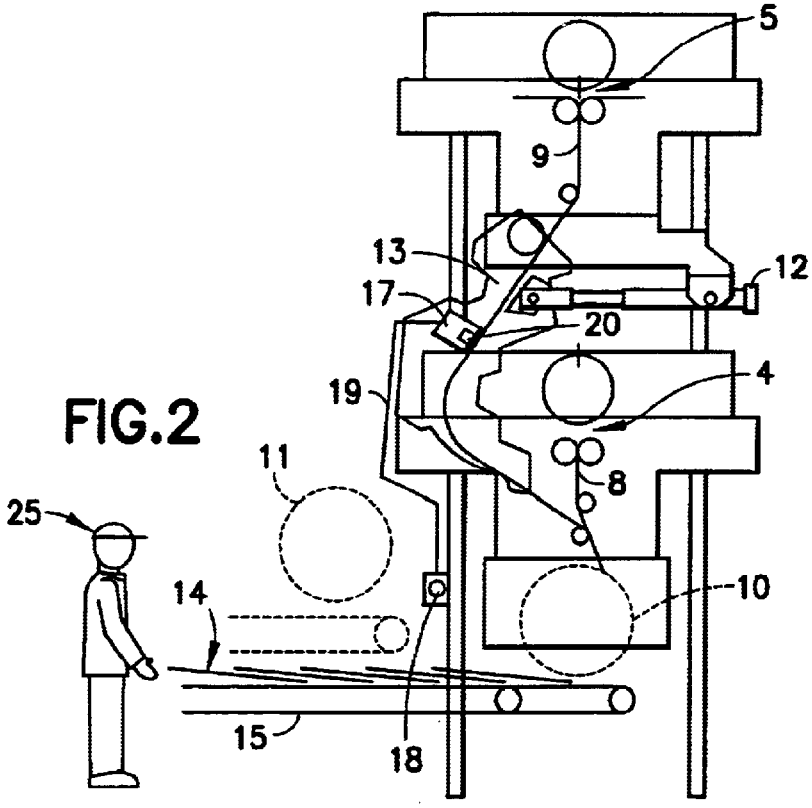
FIG. 2 shows a schematic illustration of a section of the folder taken along Line II/II in FIG. 1.

As can best be seen from FIG. 2, the sub-streams 8 and 9 respectively leaving the longitudinal-folding arrangement 4 and 5 may either be fed separately from one another to a respectively associated paddle wheel 10 or 11 or be reunited and fed to a common paddle wheel. In the example illustrated, the common paddle wheel is the paddle wheel 10, which, in the case of separate delivery, is assigned to the bottom longitudinal-folding arrangement 4. Accordingly, it is only the top product stream which is fed either into the paddle wheel 11 or into the paddle wheel 10, travel of this sub-stream associated with longitudinal folding arrangement 4 thus by passes the below described marking unit 17. For this purpose, the top longitudinal-folding arrangement 5 has provided downstream of it a transfer arrangement 13, which can be pivoted by means of a cylinder 12 and by means of which the top sub-stream 9 selectively can be fed either to the location of its own paddle wheel 11 or, together with the bottom sub-stream 8, the location of paddle wheel 10, which is assigned to the latter sub-stream 8.

FIG. 2 is based on the situation where the two sub-streams 8, 9 are fed into the paddle wheel 10 and are delivered, in the form of a common overlapping stream 14, by means of a delivery belt 15 assigned to the paddle wheel 10, the common delivery belt defining a delivery station.

Of course, production without a quarter fold is also possible. For this purpose, the longitudinal-folding arrangements 4, 5 are simply rendered passive and the through-running products are delivered without a quarter fold. For this purpose, it is possible to provide a paddle wheel 16 arranged transversely to the paddle wheels 10 and 11. In the case of such production, it is also possible to dispense with the splitting-up action. Accordingly, it is also the case that only one paddle wheel of the type indicated at 16 is required. As has already been indicated above, each paddle wheel is assigned a delivery belt, on which the products are set down in the form of an overlapping stream.

The longitudinal-folding arrangements 4, 5 can be adjusted, with the result that the quarter fold which they produce is situated precisely at the predetermined location. If the operating staff detect inaccuracies in the position of the quarter fold, the relevant longitudinal-folding arrangement 4 or 5 is adjusted such that the defect is corrected. In order for it to be possible in the case of the type of operation on which FIG. 2 is based, in which the products of the two sub-streams 8, 9 are delivered in the form of a common overlapping stream 14, for products which have a defective or inaccurate quarter fold to be assigned to either of the sub-streams 8 and 9 straight away, and for the relevant folding arrangement 4 or 5 to be adjusted in a quite specific manner, the products of one sub-stream 8 or 9 are marked. It is sufficient if, upon detection of a defect of the above mentioned type, the marking takes place for just a short time.

Provided for this purpose is a marking arrangement or unit 17 which is assigned to one of the sub-streams 8, 9 and can be activated manually by means of a switching arrangement 18 arranged in the region of the delivery belt 15, as is indicated by the signal line 19. A printer 25 who is monitoring the overlapping stream 14 transported away by means of the delivery belt 15, and who detects inaccuracies in the quarter fold on individual products, can actuate the switching arrangement 18 immediately, as a result of which the marking arrangement 17 is activated. Activation for just a short time is sufficient. Even just a short period of time after the activation of the marking arrangement 17, the marked products within the common overlapping stream appear on the delivery belt 15. The marking makes it possible for each product to be assigned to the associated sub-stream 8 or 9, with the result that, depending on which products are defected, the folding arrangement 4 or 5 can be adjusted.

In the exemplary embodiment illustrated, the marking arrangement 17 is assigned to the sub-stream 9, which passes the top longitudinal-folding arrangement 5. If the marked products display a defective quarter fold, the operating staff thus know that the top longitudinal-folding arrangement 5 has to be adjusted. If the unmarked products display a defective quarter fold, the bottom longitudinal-folding arrangement 4 has to be adjusted.

The marking arrangement 17 is expediently arranged in the region between the common delivery arrangement, in this case the paddle wheel 10, and an upstream longitudinal-folding arrangement, in this case the longitudinal-folding arrangement 5. This ensures that the products are marked on their outside, with the result that it is easy to see the marked products in the region of the overlapping stream 14. In the example illustrated, the marking arrangement 17 is arranged on the pivotable transfer arrangement 13, which provides sufficient space for this purpose.

The products may be marked mechanically, for example by notching, etc. It is expedient, in order to mark the products, for a liquid marking means in the form of dye or ink to be applied to said products. The marking arrangement 17 is preferably arranged and/or controllable such that the marking takes place only in a product region which can be removed during subsequent processing of the products, for example in the region of a border which can be removed when a subsequent straight cut is carried out.

Instead of dye or ink, it is also possible to apply a fluorescent marking means which is invisible in normal light and can be made visible by UV light or black light. The advantage here is that a marking can be made in the centre of the printing without the latter being rendered unusable.

The marking arrangement 17 is expediently provided with a spraying or jetting nozzle 20 in order to apply the marking means in a contact-free manner. However, it would also be conceivable to use a sweeping nozzle. Use of a jetting nozzle which produces a thin, concentrated jet advantageously allows the marking application to be placed in a specific position.

The products of one sub-stream can remain unmarked at all times since it is possible to make a distinction by virtue of the products of every other sub-stream being marked. Should more than one other sub-stream be present, the products of these sub-streams have to be marked differently in order the desired distinction can be made. The same applies, obviously, if the products of all the sub-streams are marked.

The invention is not limited by the embodiments described above which are presented as examples only but can be modified in various ways within the scope of protection defined by the appended patent claims.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

We claim:

1. Process for producing folded products comprising:

splitting a feeding stream of products into at least two product sub-streams;

passing each sub-stream through a sub-stream associated final folding unit for final folding the products;

reuniting the final folded product sub-streams downstream of the final folding units into a products common stream;

monitoring the products common stream to detect any final folding inaccuracies therein; and on detection of a folding inaccuracy, marking the products of a first one of said sub-streams following final folding but before reuniting said sub-streams so that said first one sub-stream products are identifiable in said common stream from products of a second sub-stream whereby an adjustment can be made to the final folding unit associated with the sub-stream containing the folded products having folding inaccuracies to eliminate said inaccuracies.

2. A process according to claim 1, wherein the marking of the products is applied to a part of the product which can be removed in subsequent product processing.

3. A process according to claim 1, wherein the product marking is one of a visible marking and a marking visible only under one of UV light and black light.

4. A folder for producing folded products, comprising:

a diverter for splitting a feeding stream of products into at least two product sub-streams;

separate adjustable folding units associated with each of said sub-streams for longitudinally folding the products in said sub-streams;

a common delivery station, the sub-streams passing from the said folding units downstream for delivery of said products to said common delivery station; and a marking unit disposed proximal a travel course of one of said sub-streams for marking the products in said one sub-stream, a second of said sub-streams has a travel course which bypasses said marking unit.

5. A folder according to claim 4, wherein said marking unit is manually activated.

6. A folder according to claim 4, comprising a switching device for actuating the marking unit, said switching device being located proximal the common delivery station.

7. A folder according to claim 4, wherein said folding units are disposed one above another, a travel course of the sub-stream associated with a lowermost folding unit bypassing said marking unit, a marking unit disposed proximal a travel course of any sub-stream associated with a folding unit above said lowermost folding unit being mounted on a transfer arrangement downstream of any associated upper folding device, said transfer arrangement being operable to direct a travel of said any sub-stream selectively to one of two downstream locations.

8. A folder according to claim 4, wherein products of said one of said sub-streams are identifiable in said common delivery station from products of said second of said sub-streams when said marking unit is marking the products in said one of said sub-streams.

9. A folder according to claim 4, wherein the marking unit includes a nozzle for discharging a marking fluid therefrom.

10. A folder according to claim 9, wherein said nozzle is a jetting nozzle for delivering a contact free jet of marking fluid onto said products.

11. A folder for producing folded products, comprising:

a diverter for splitting a feeding stream of products into at least two product sub-streams;

separate adjustable folding units associated with each of said sub-streams for longitudinally folding the products in said sub-streams;

a common delivery station, the sub-streams passing from the said folding units downstream for delivery of said products to said common delivery station; and a marking unit disposed proximal a travel course of one of said sub-streams for marking the products in said one sub-stream, wherein said marking unit is disposed at a location between said common delivery station and the folding unit associated with said one sub-stream.

12. A folder for producing folded products, comprising:

a diverter for splitting a feeding stream of products into at least two product sub-streams;

separate adjustable folding units associated with each of said sub-streams for longitudinally folding the products in said sub-streams;

a common delivery station, the sub-streams passing from the said folding units downstream for delivery of said products to said common delivery station; and a marking unit disposed proximal a travel course of one of said sub-streams for marking the products in said one sub-stream, wherein said marking unit is disposed such as to mark only a part of the product which can be removed in subsequent processing of the product.

* * * * *